United States Patent [19]

Howitt

[11] 4,373,304

[45] Feb. 15, 1983

[54] PREFABRICATED BUILDING UNITS

[76] Inventor: Ronald W. Howitt, 19 Holland Ct., Moana Park, Queensland, Australia, 4217

[21] Appl. No.: 187,798

[22] Filed: Sep. 16, 1980

[30] Foreign Application Priority Data

Mar. 18, 1980 [AU] Australia ..... PE2790

[51] Int. Cl.[3] ..... E04B 7/16; E04C 1/30

[52] U.S. Cl. ..... 52/73; 52/282; 52/293; 52/582

[58] Field of Search ..... 52/74, 73, 68, 69, 780, 52/281, 90, 93, 282, 262, 264, 293, 122, 97, 403, 536, 75, 76, 394, 395, 582

[56] References Cited

U.S. PATENT DOCUMENTS

| | | | |
|---|---|---|---|
| 2,828,842 | 4/1958 | Plumley et al. | 52/582 |
| 2,848,765 | 8/1958 | Showalter | 52/74 |
| 3,156,210 | 11/1964 | Lyon | 52/394 |
| 3,566,554 | 3/1971 | Schaffer et al. | 52/73 |

*Primary Examiner*—Price C. Faw, Jr.

*Assistant Examiner*—Mike Safavi

*Attorney, Agent, or Firm*—Schwartz, Jeffery, Schwaab, Mack, Blumenthal & Koch

[57] ABSTRACT

Prefabricated building units for constructing a small building such as a caravan annexe include a mounting rail which may be supported at roof height, for example on a caravan side, and a number of rectangular roofing panels, each having across its head an attachment piece releasably engageable pivotally with the mounting rail when the roofing panel is at an angle to horizontal greater than the pitch of the roof to be installed, sealing means being brought into effect when the roofing panel is raised pivotally to the required pitch. The units include rectangular wall panels each with an attachment piece across its head engageable, as set out, with a mounting rail across the foot of each roofing panel. Opposite sides of each roofing panel and wall panel have respectively, a weather capping, and a weather flange engageable in the weather capping of an adjacent like panel.

4 Claims, 6 Drawing Figures

14
25
24
23
19
16
22
21
17
13
15
20
12
10
11
18
2
26
27
31
32
28
29
30
34
35
36
33

35
37
38
39
36
18
18

34
39a
26

3
3
51
18
50

42
46
35
41
43
44
45
37
40
57
52
49
55
56
55
18
18
53
54

33
47
48

PREFABRICATED BUILDING UNITS

BACKGROUND OF THE INVENTION

This invention relates to improved pre-fabricated building units.

The fairly restricted living space of a caravan is frequently extended by the addition of an annexe, particularly when the caravan is set up to remain on the one site for an extended period. Such an annexe normally consists of a roof, end walls and a side wall, all made of a suitable fabric, supported by a framework of tubular metal members releasably interconnected. Although an annexe of this description is usually expensive, the fabric is not likely to last very long when exposed to strong sunlight and other adverse weather conditions, and moreover is likely to be hot in summer and draughtly in windy conditions.

The present invention has been devised with the general object of providing pre-fabricated building units, applicable to the construction of a caravan annexe, but equally applicable to the erection of other light or temporary buildings, the structure erected from the units being quickly assembled or dismantled, sturdy and durable in use, and with good heat-insulating and weatherproofing qualities.

SUMMARY OF THE INVENTION

Pre-fabricated building units according to the invention include a mounting rail which is adapted to be supported substantially horizontally at roof height, either on a side of a caravan or building, or at the top of a wall, or on posts. A number of substantially rectangular roofing panels are provided, each having an engagement piece across its head, this engagement piece being adapted, when the roof panel is at an angle to horizontal greater than the pitch of the roof to be installed, to be engaged pivotally with the mounting rail. Sealing means are provided, being adapted, when the roof panel is raised pivotally to the said pitch, automatically to effect a seal between the mounting rail and engagement piece. The units include wall panels and interengaging members at the head of each wall panel, and at the outer end of each roofing panel, such interengaging members being made for pivotal engagement one with the other when the angle between the roofing panel and wall panel unit is less than in normal erected arrangement, and sealing means for effecting a seal between the roofing panel and wall panel when the wall panel is brought to vertical, the roofing panel being at the required pitch. Interfitting edge members are provided on the sides of the roofing panels and of the wall panels for interfitting in sealed manner to effect seals between adjacent roofing panels and wall panels. Other features of the invention will become apparent from the following description.

BRIEF DESCRIPTION OF THE DRAWINGS

In order that various embodiments of the invention may be readily understood, and carried into practical effect, reference is now made to the accompanying drawings, wherein.

DETAILED DESCRIPTION OF THE PREFERRED EMBODIMENTS

Figures 1, 2, 3, 4, 5, 6:
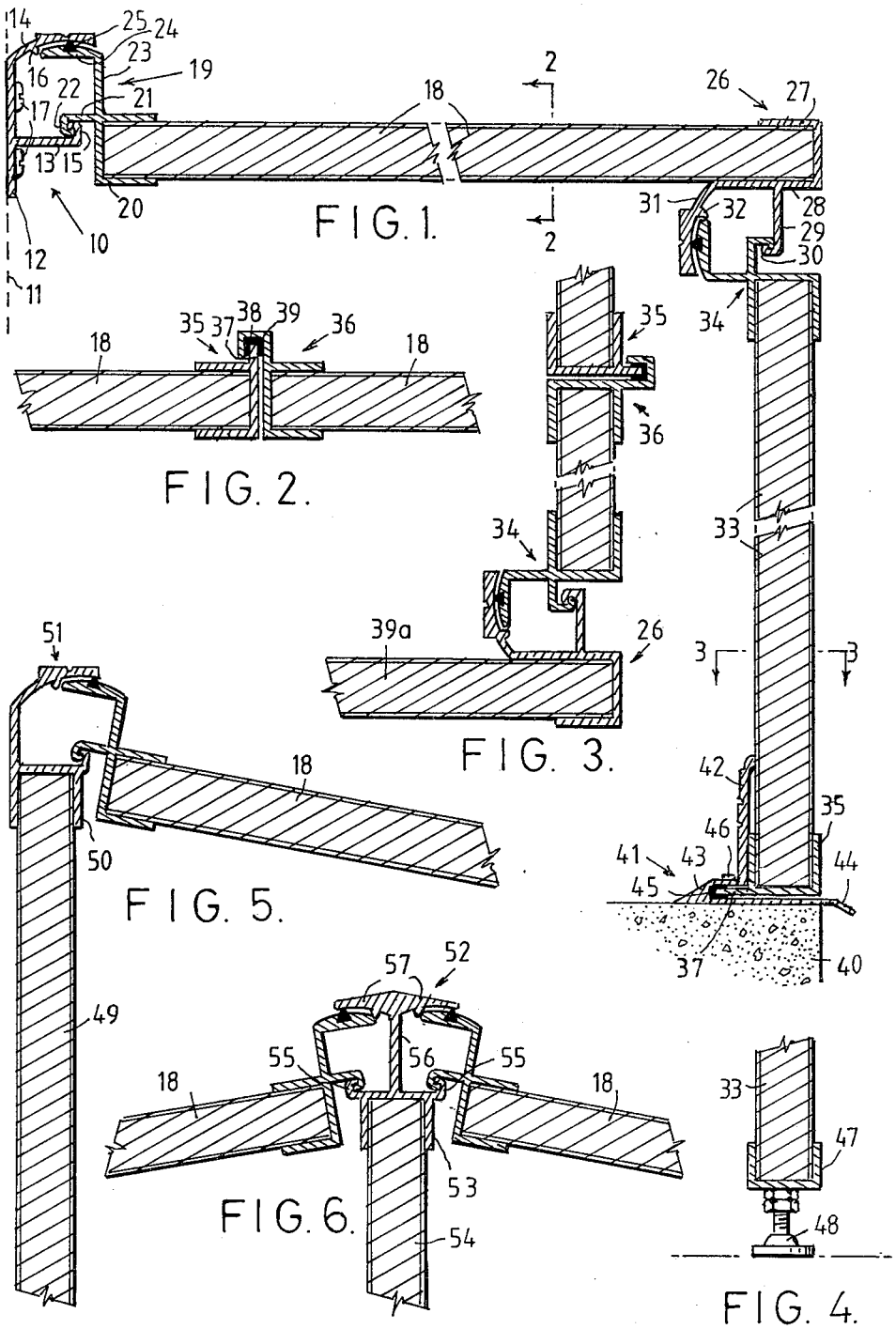
FIG. 1 is a partly broken-away sectional view of pre-fabricated building units according to the invention arranged to form the roof and side wall of an annexe.
FIG. 2 is a section on line 3—3 in FIG. 1 showing the interconnection of the roof panels.
FIG. 3 is a section on line 3—3 of FIG. 1 showing the interconnection of side and end wall panels.
FIG. 4 illustrates in section a modified form of the lower part of a wall panel.
FIG. 5 is a partly broken-away sectional view showing building units according to the invention modified for use in the erection of a skillion-roof type structure.
FIG. 6 is a partly broken-away sectional view of a further modified form of the invention, applicable to the construction of a building having a gable roof.

Referring initially to FIGS. 1, 2 and 3 of the drawings, a mounting rail 10 of extruded metal, preferably aluminum, is secured horizontally to a side, indicated in broken outline at 11, of a caravan or building. The rail 10 has an attachment plate 12 from which there extends a fulcrum flange 13 and a curved flange 14, the fulcrum flange 13 having its distal end 15 hook-shaped in section. The surface of the curved flange which is nearer to the fulcrum flange is, in cross-section, curved to an arc centered on a point more or less centrally within the hook 15 of the fulcrum flange, this curve being interrupted by a small stop bead 16. The mounting rail 10 is fixed to the side of the caravan or building by screws 17 through the attachment plate 12.

The roof of the structure is composed mainly of a number of roof panels 18 of sandwich construction with a heat-insulating core of expanded polystyrene or other suitable material sheeted on both sides with aluminum or other suitable sheet material secured adhesively to the core.

Across one end of each of the roof panels 18 there is fixed an extruded metal engagement section 19 formed with a channel 20 in which the panel end is secured adhesively. This engagement section also has a pivot flange 21 with a hooked end portion 22, a flange 23 perpendicular to the pivot flange 21 and to the roof panel 18, and a curved flange 24 extending substantially parallel to the pivot flange 21 and with an outer surface which in section is curved to an arc centred in a point in the hooked part 22 of the pivot flange 21. A resilient sealing strip 25 is secured in a dovetailed longitudinal groove formed from the curved surface of the flange 24.

Each roof panel, held more or less upright with the engagement section 19 uppermost, is manipulated to engage the hooked portion 22 of the section 19 with the hooked portion 15 of the mounting rail 10. The lower end of the roof panel is then raised so that the curved flange 24 of the engagement section 19 passes closely under the correspondingly curved flange 14 of the mounting rail 10, the sealing strip 25 effecting a seal between the two.

The end of the roof panel 18 remote from the engagement section 19 is secured in another extruded metal section 26 which is generally of similar sectional shape to the mounting rail 10, with the addition of a channel 27 to receive the roof panel end, one flange 28 of this channel being formed with a fulcrum flange 29 with a hooked end 30, and with a curved flange 31 with a stop bead 32, these flanges being similar to the flanges 13 and 14 of the mounting rail.

The outer or free end of each roof panel 18 is supported by a wall panel 33, of sandwich type like the roof panels, the normally upper end of each wall panel being fixed in an extruded metal section 34 similar to the extruded engagement section 19 of each roof section, and the extruded section 34 is engaged with the roof panel extruded section 26 in the same manner that the roof panel engagement section 19 is engaged with the mounting rail 10.

The manner of weatherproofing the junctions of succeeding roof panels 18 is shown in FIG. 2, one side edge of each panel being secured in an extruded channel 35, its other side edge being secured in an extruded channel 36, the channel 35 having a weather flange 37 on which is engaged a channelled resilient weather strip 38, the channel 36 being formed with a weather capping 39 which fits closely over the weather flange 37 and weather strip 38 of the next succeeding roof panel.

As shown in FIG. 3, adjacent side wall panels 33 are connected together in sealed manner similarly to the roof panels 18, the sides of the panels 33 being secured in extruded sections 35 and 36, as described with reference to FIG. 2. Adjacent end wall panels 39 are similarly interconnected, and each end of the side wall is connected perpendicularly to an end wall panel 39 by the use of an extruded section 26 and a further extruded section 34 made and interfitted as described with reference to FIG. 1.

In many cases, the structure will be erected over a concrete slab 40, in which case an extruded section 41 is applied to a side and the ends of the slab. This section includes an upright skirting piece 42 formed integrally with a horizontal channel 43 the lower flange of which, resting on the slab 40, is extended beyond the slab and downturned, to form a flashing piece 44. The bottom of each side wall panel 33 or end wall panel 39 is secured in a channelled extrusion 35, as described with reference to FIGS. 2 and 3, the weather flange 37 of the extrusion 35 engaging in the channel 43 of the extruded section 41 which is provided with an internal channelled sealing strip 45. Fasteners 46 of any suitable type are driven through the channel 43 and the inserted weather flange 37 and into the slab 40, the skirting piece 42 then lying close to the bottom part of the wall panel.

Certain of the wall panels 33 and 39 may be made with windows (not shown) or may be formed with doorways or arranged to leave doorways. Although the roof of the structure is shown in FIG. 1 as horizontal, it may be erected with a pitch, the end wall panels being shaped to accommodate to this.

If the structure is to be erected as a caravan annexe standing on the ground instead of on a slab 40, the bottoms of the wall panels may, as shown in FIG. 4, be simply fixed in a channel 47 provided with adjustable supporting feet 48.

Certain of the wall panels 33 may be formed with windows or doors, and end wall panels (not shown) may be provided to form the ends of the annexe. The end panels may be made for releasable connection in any suitable way to the roof panels 18 and wall panels 33 and also to the side 11 of the caravan or building.

FIG. 5 shows the application of the invention to a free-standing building of skillion-roof type, in which a front wall is constructed of a number of front wall panels 49 having their upper ends removably engaged in a channel 50 formed on an extruded metal rail 51 which otherwise is generally similar to the mounting rail 10 of FIG. 1. The roof is composed of roof panels 18, as before described, and the back wall of the building is made up of wall panels 33 before described.

FIG. 6 shows the application of the invention to a free-standing gable-roof building. An extruded metal ridge rail 52 has an inverted bottom channel 53 in which the upper ends of partition wall panels 54 are removably engaged to support the ridge rail, or alternatively this rail may be supported by any suitable posts (not shown). The top of the inverted channel 53 is, at both sides, extended and shaped to hook-like forms to constitute fulcrums 55, and a central web 56 extending up from the channel top is formed at the top with two oppositely directed curved flanges 57. Roof panels 18 as before described are engaged with both sides of the ridge rail 52 and are supported by side and end wall panels as before described.

I claim:

1. Prefabricated building units including:

a mounting rail, means for supporting the mounting rail substantially horizontally at roof height, a plurality of substantially rectangular roofing panels, an engagement piece across the head of each roofing panel capable, when the roof panel is at an angle to horizontal greater than the pitch of the roof to be installed, of being releasably engaged pivotally with the mounting rail, and sealing means which, when the roofing panel is raised pivotally to the said pitch, automatically effects a seal between the mounting rail and the engagement piece;

wherein:

the mounting rail and the engagement piece are formed with hooked members releasably interengageable pivotally, the mounting rail includes a flange with an underside curved in cross-section, the attachment piece includes a flange with a normally upper surface so curved in cross-section that when the roof panel is raised pivotally to the said pitch it moves closely under the curved underside of the mounting rail flange, and the sealing means includes a sealing strip which, when the roof panel is raised pivotally to the said pitch, is brought between the curved surfaces of the mounting rail flange and the attachment piece flange.

2. Prefabricated building units according to claim 1 wherein:

stop means are provided for preventing pivotal movement of the engagement piece beyond the said pitch, relative to the mounting rail.

3. Prefabricated building units according to claim 1 wherein:

each of the roofing panels has along one side an upwardly extending weather capping of inverted channel form and along its other side an upwardly extending weather flange engageable in the weather capping of an adjacent roofing panel.

4. Prefabricated building units according to claim 1 including a plurality of substantially rectangular wall panels, and wherein:

each of the roofing panels has across its foot a mounting rail, and each of the wall panels has across its head an engagement piece capable, when the wall panel is at an angle to vertical, of being releasably engaged pivotally with the mounting rail on the roofing panel, and sealing means which, when the wall panel is moved pivotally to vertical, automatically effects a seal between the mounting rail of the roofing panel and the engagement piece of the wall panel.

* * * * *